United States Patent [19]

Cavender

[11] 3,993,814

[45] Nov. 23, 1976

[54] WEB OF RECORD ASSEMBLIES

[75] Inventor: Donald E. Cavender, Centerville, Ohio

[73] Assignee: Monarch Marking Systems, Inc., Dayton, Ohio

[22] Filed: Nov. 4, 1974

[21] Appl. No.: 520,710

[52] U.S. Cl. ..... 428/40; 40/2 R; 206/813; 206/820; 281/5; 283/18; 428/41; 428/131; 428/137

[51] Int. Cl.[2] ..... G09F 3/10

[58] Field of Search ..... 161/406, 167, 37, 38, 161/40, 41; 206/460, 447, 813, 820; 40/2, 125 A; 281/5; 428/40; 283/18, 12.1

[56] References Cited

UNITED STATES PATENTS

| | | | |
|---|---|---|---|
| 2,700,556 | 1/1955 | Holmwood | 281/5 |
| 2,797,801 | 7/1957 | Bishop | 206/460 |
| 3,014,580 | 12/1961 | Brody et al. | 206/820 |
| 3,226,862 | 1/1966 | Garbuk | 40/2 R |
| 3,383,121 | 5/1968 | Singer | 40/2 R |
| 3,621,992 | 11/1971 | Osborne et al. | 206/820 |
| 3,706,626 | 12/1972 | Smith et al. | 40/2 R |

OTHER PUBLICATIONS

Traffic Management "Three-in-One Labeling System", p. 120, Sept. 1973.

Purchasing Magazine, "Computer Printed Labels", Monarch Marking Systems, Sept. 1970.

Kimball Systems, "Able-Stik Pinfeed Labels", 8 pp. Sept. 1973.

Avery Pinfeed Labels, No. 192.2, (1965), Avery Adhesives Co., Monrovia, Cal.

*Primary Examiner*—George F. Lesmes
*Assistant Examiner*—R. J. Roche
*Attorney, Agent, or Firm*—Joseph J. Grass

[57] ABSTRACT

There is disclosed a web of record assemblies and a method of using same. The web is a composite web constructed by using both a longitudinally extending web of supporting material and a web of label material releasably adhered to the supporting material by means of pressure sensitive adhesive. The composite web is formed into a plurality of record assemblies by means of a plurality of transversely spaced-apart lines of partial severing in the supporting material and by either butt cutting or die cutting the label material. The label material of each record assembly is, according to one embodiment, partially severed along a longitudinal line and the supporting material is completely severed along the same longitudinal line. The label material on one side of the longitudinal line is divided into record sections containing one or more labels.

12 Claims, 12 Drawing Figures

WEB OF RECORD ASSEMBLIES

BACKGROUND OF THE INVENTION

1. Field of the Invention

This invention relates to the art of webs of record assemblies and to methods of using same.

2. Brief Description of the Prior Art

It has been found desirable in the prior art to provide composite webs of record assemblies in which labels forming part of the record assemblies can be printed in a line printer or other suitable machine. In such a prior art record assembly, part of the label material, which is of generally T-shaped configuration, constitutes a carrier label and the remainder constitutes a single record section having labels on which price and/or other data is printed. When the supporting material is removed from the carrier label, the single record section is positioned in underlying relationship with respect to the carrier label at a generally central zone. The disadvantage with this arrangement is that the width of the single record section has to be less than the width of the carrier label so that after the record section was positioned in underlying relationship to the carrier label there is enough exposed adhesive outboard of the record section to adhere the carrier label to the package. Thus, there was a considerable wastage of label material. When the package arrives at its destination, the record section is removed from the carrier label by tearing the carrier label, making the labels available to be applied to merchandise within the package. U.S. Pat. No. 3,484,976 dated Dec. 23, 1969 to J. C. Shea discloses a record assembly having plural record sections.

SUMMARY OF THE INVENTION

The invention is directed to a composite web of record assemblies in which the above mentioned problem of label wastage has been obviated. By providing certain lines of partial and/or complete severing in the label material and the supporting material it has been found that it is not necessary to die out or waste substantial portions of the label material. This is accomplished by providing at least three record sections, such that the two outboard record sections are folded inwardly from the ends of the record assembly. By thereafter positioning the folded record sections under a central zone of a carrier label from which the supporting material has been removed, the carrier label is used to attach the record sections to a package or other suitable surface by means of the exposed adhesive located outboard of a central zone of the carrier label. In a specific embodiment of the invention the composite web has a longitudinally extending web of supporting material and printable label material having a coating of pressure sensitive adhesive releasably adhered to the supporting material. There are lines of partial severing in the supporting material web extending transversely across the entire width of the supporting material web at longitudinally spaced-apart intervals to provide a plurality of record assemblies. There is a line of at least partial severing in the supporting material web extending longitudinally between side edges of the supporting material web. There are a plurality of second lines of partial severing in the supporting material web between each pair of adjacent first lines of partial severing and extending transversely of the supporting material web at longitudinally spaced-apart intervals. The second lines of partial severing extend between an edge of the supporting material web and the longitudinal line of at least partial severing. A line of partial severing in the label material extends longitudinally along generally the same lines as the longitudinal line of at least partial severing in the supporting material web. A plurality of lines of at least partial severing in the label material extend transversely of the supporting material web along generally the same lines as the second lines of partial severing in the supporting material web. The second lines of partial severing in the supporting material web and the second lines of at least partial severing in the label material divide the portions of the record assemblies on one side of the longitudinal line into at least three record sections. The record sections are foldable upon each other and are positionable under the portion of the label material on the other side of the longitudinal line. In another embodiment of the invention, the label material is at least partially severed along the longitudinal line and the supporting material is partially severed along the longitudinal line. In either of the embodiments the label material on the record assemblies can be formed either by butt cutting the label material or by fully die cutting the label material. Fully die cutting the label material will cause gaps to exist between the label material of adjacent record assemblies. In all the embodiments, it is preferred that the label material be of rectangular configuration to minimize label wastage.

DETAILED DESCRIPTION OF THE PREFERRED EMBODIMENTS

Figure 1:
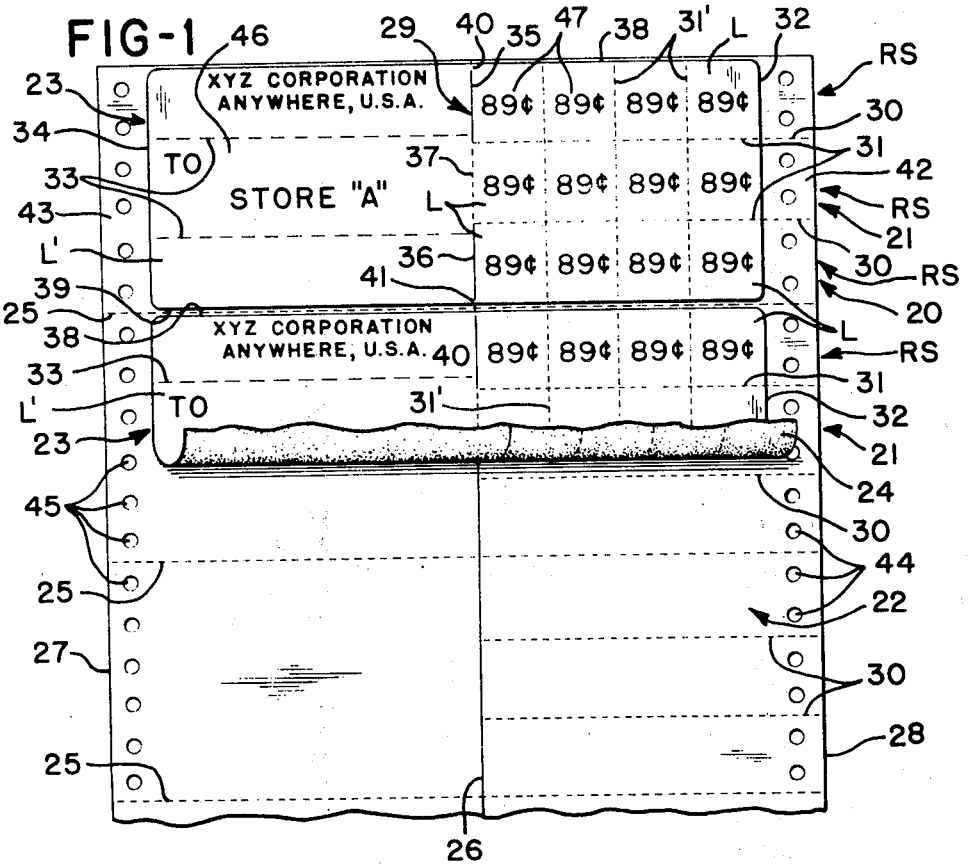
FIG. 1 is a partly broken away top plan view of the record assembly in accordance with one embodiment of the invention.
Figure 10:
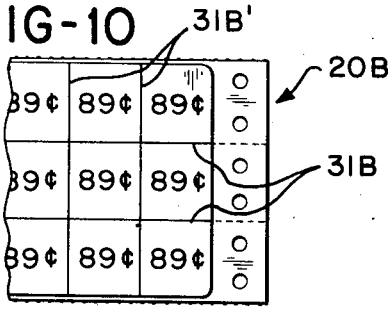
FIG. 10 is a fragmentary top plan view of a record assembly showing alternate complete severing in the label material.

With reference to FIG. 1, there is shown a composite web generally indicated at 20 of record assemblies 21. The web 20 is constructed of a web of supporting material 22 and a web of printable label material 23 releasably adhered by means of pressure sensitive adhesive 24 to the supporting material 22. In making the composite web 20 of record assemblies 21, the supporting material 22 is partialy severed at longitudinally spaced-apart intervals along transversely extending lines of partial severing 25. There is also formed a line of at least partial and specifically complete severing 26 which extends in the longitudinal direction between side edges 27 and 28 of the supporting material web 22. The label material 23 is shown to be partially severed as generally indicated at 29 along the same longitudinally extending line as the line of complete severing 26. The supporting material web 22 is shown to include transversely extending lines of partial severing 30 disposed at longitudinally spaced-apart intervals. The lines 30 are shown to extend from side edge 28 of the supporting material of web 22 to the line of complete severing 26. The label material 23 is shown to include transversely extending longitudinally spaced-apart lines of at least partial severing 31 extending from an edge 32 of the label material 23 to the longitudinal line 29. The label material 23 is also shown to include longitudinally extending transversely spaced-apart lines of at least partial severing 31'. The lines 31 and 31' are shown to be lines of partial severing although the label material 23 is at least partially severed along the lines 31 and 31' and can be completely severed as shown in FIG. 10. The lines of at least partial severing 31 divide the label material 23 of the record assembly 21 on one side of the line of partial severing 29 into record sections RS. The lines of at least partial severing 31' divide the label material 23 of the record sections RS into a plurality of labels L. The at least partial severing 31 extends along the same line as the partial severing 30 in the supporting material web 22.

Lines of partial severing 33 are shown to extend from side edge 34 of the label material 23 and the line of partial severing 29. As shown in the drawings, the lines 33 of partial severing of each record assembly 21 are more widely spaced apart than are the lines of at least partial severing 31.

The line 29 of partial severing of each record assembly 21 more specifically includes a pair of elongated complete severing 35 and 36 in the label material 23 and partial severing 37 extending between adjacent ends of the complete cuts 35 and 36. The other ends of the complete severing 35 and 36 which are adjacent end edges 38 and 39 of the label material 23 terminate short of the respective end edges 38 and 39 to provide respective lands 40 and 41.

The side edges 32 and 34 of the label material 23 of each record assembly 21 are spaced from the respective side edges 28 and 27 of the supporting material web 22 to provide feed strips 42 and 43 at the marginal side edges of the supporting material 22. The feed strips 42 and 43 are provided with respective feed holes 44 and 45 between which the web of record assemblies can be fed through a line printer or other suitable printer to print data on the record assemblies 21. In such a printer information such as the name and address of a branch store illustrated in FIG. 1 as being store A indicated at 46 can be printed on label L' disposed between edge 32 and the line of partial severing 29. The labels L can also be printed with the appropriate data shown to be the price 89 as indicated at 47.

Figure 2:
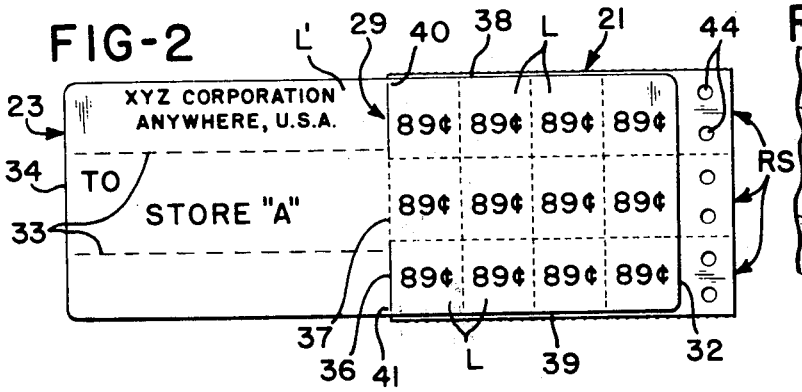
FIG. 2 is a top plan view of one of the record assemblies shown in FIG. 1, with supporting material removed from a carrier label of the record assembly.
Figure 3:
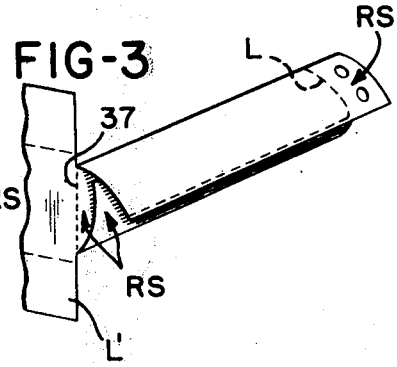
FIG. 3 is a fragmentary perspective view showing the manner in which outboard record sections of a record assembly are folded inwardly from the ends of the assembly.
Figure 4:
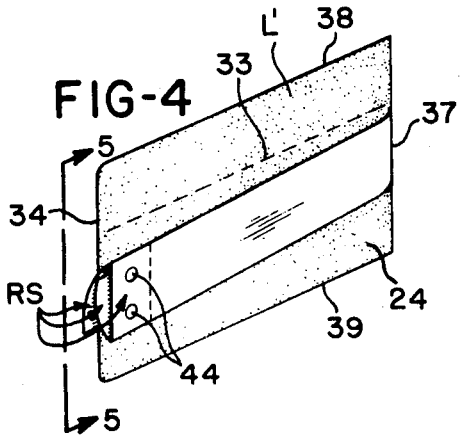
FIG. 4 is a perspective view showing the manner in which the folded record sections are positioned in underlying relationship and in contact with the adhesive at a generally central zone on the underside of the carrier label.
Figure 5:
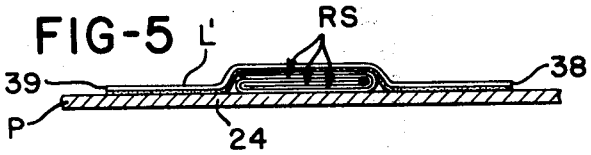
FIG. 5 is a sectional view taken generally along line 5—5 of FIG. 4, but showing the carrier label and the record sections which it carries adhered to a surface.
Figure 6:
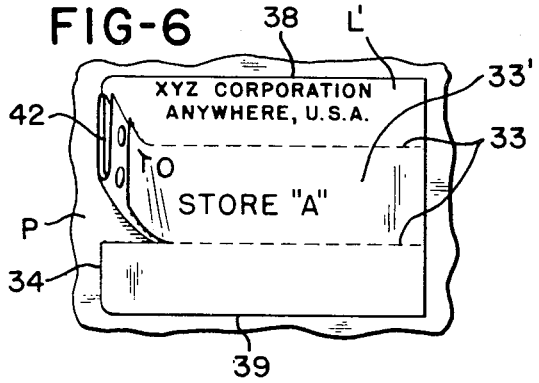
FIG. 6 is a top plan view of a record assembly applied to a surface.
Figure 7:
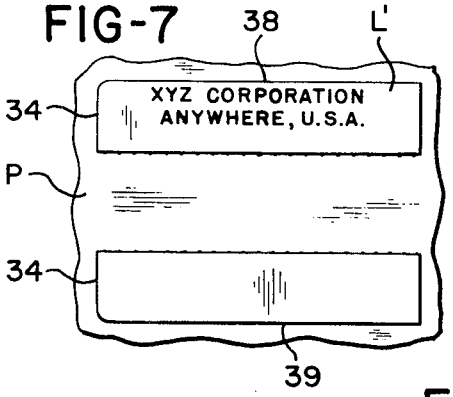
FIG. 7 is a top plan view similar to FIG. 6, but showing part of the carrier label removed together with the record sections.
Figure 8:
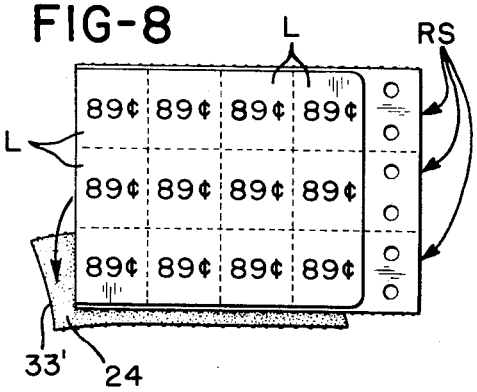
FIG. 8 is a top plan view of the part of the carrier label and the record sections that have been removed from the remaining part of the carrier label shown in FIG. 7.
Figure 9:
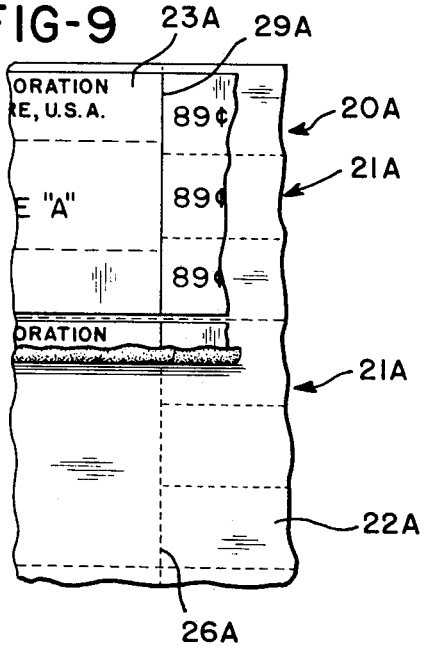
FIG. 9 is a fragmentary top plan view of an alternative embodiment of the composite web of record assemblies.

Following printing of as many record assemblies 21 as is desired, the record assemblies 21 are separated by tearing them apart along lines of partial severing 25. The method of attaching or applying an assembly 21 to a package P or any other suitable surface is best illustrated in FIGS. 2 through 8. FIG. 2 illustrates one of the record assemblies 21 with its supporting material peeled from the underside of the label L'. The lands 40 and 41 are torn and the outboard record sections RS are folded inwardly into overlying relationship as shown in FIG. 3. If desired, the record sections RS can be folded in this manner before the supporting material is removed from the label L'. The record sections RS are then positioned in underlying relationship to the label L' by bending or pivoting the folded record sections RS about partial severing 37 to the position shown in FIG. 4. FIG. 5 shows the label L' adhered by means of the adhesive 24 to the surface of a package P. FIG. 5 shows the label L' acting as a carrier for the record sections RS in that it holds the record sections RS against the package P. It is noted that the adhesive 24 that contacts the one record section RS in FIG. 5 is against the supporting material of that record section RS and because of the easy release characteristics of the supporting material is only lightly adhered thereto. Now that the record assembly 21 (minus the supporting material 22 under the label L') has been applied to the package P, the package P is shipped to the desired location, in this instance store A. When the merchandise has reached store A the user can grasp the supporting material 22 at the feed strip 42 and use the feed strip 42 as a tab. It is noted that lines of partial severing 33 are spaced apart more widely than lines 31. The central section 33' of the label L' is defined by adjacent partial severing 33. Thus, the width of the record sections RS is slightly less than the width of a central zone defined by the lines of partial severing 33. By pulling on this tab, the label L' can be torn along lines of partial severing 33 as depicted in FIG. 6. Once the label L' has been completely severed along lines of partial severing 33 as shown in FIG. 7, the outboard record sections RS are no longer held captive and can be unfolded thereby exposing labels L. The labels L are now ready to be applied to the merchandise or other contents of the package P. If for example the contents of the package P contain 12 items to be labeled there is a label for each item. If its apparent that the record sections can be made large enough to accomodate any desired number of labels thereon.

The composite web 20A of record assemblies 21A is identical to the composite web 20 of the embodiments of FIGS. 1 through 8, the only exceptions being that instead of a line of at least partial and specifically complete severing 26 in the supporting material web 20 there is a line of partial severing 26A in supporting material web 22A and that instead of a line of partial severing 29 in the material 22 there is a line of at least partial and specifically complete severing 29A in labael material 23A.

In the embodiment of FIG. 10, composite web 20B, comprises of a supporting material web 22B and label material 23B, is identical to the composite web 20 of the embodiments of FIGS. 1 through 8, except that lines of at least partial severing 31 and 31' in the embodiments of FIGS. 1 through 8 are lines of complete severing 31B and 31B' in the embodiment of FIG. 10.

Figure 11:
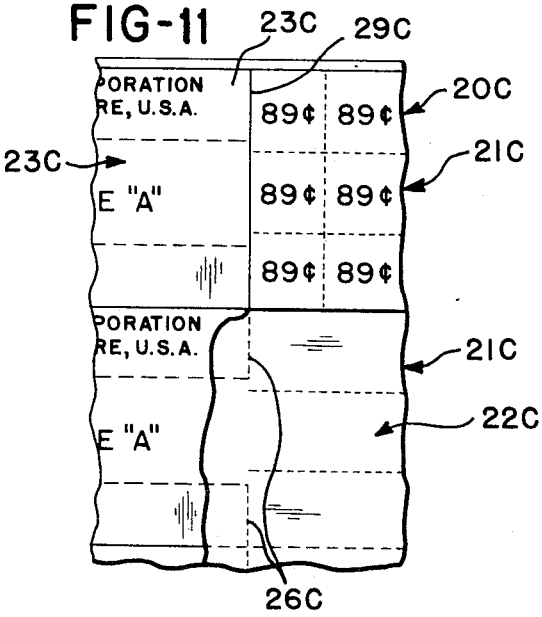
FIG. 11 is a fragmentary top plan view of another alternative embodiment.

The composite web 21C illustrated in the embodiment of FIG. 11 is identical to the composite web 20 of the embodiments of FIGS. 1 trough 8, except that instead of a line of complete severing 26 in supporting material web 22C there is provided a line of interrupted partial severing 26C and instead a line of partial severing 39 there is provided a line of complete severing 29C in the label material 23C. Another difference in the embodiment of FIG. 11 is that ends of the label material 23C of adjacent record assemblies 21C are in abutment in that they are made with butt cuts through the label material.

Figure 12:
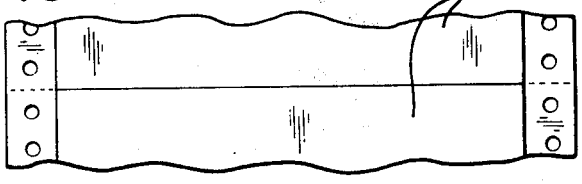
FIG. 12 is a fragmentary top plan view showing an alternative view.

FIG. 12 illustrates the manner in which the label material of the embodiments of FIGS. 1 through 8, 9 and 10 can be made by butt cutting label material 23D which corresponds respectfully to the label material 23, 23A and 23B.

It is preferred in the illustrated embodiments that the label material respectively designated at 23, 23A, 23B, 23C and 23D is of a generally rectangular configuration as shown, which obviates label wastage evident in the prior art.

Other embodiments and modifications of this invention will suggest themselves to those skilled in the art, and all such of these as come within the spirit of this invention are included within its scope as best defined by the appended claims.

I claim:

1. A web of record assemblies, comprising: a composite web having a longitudinally extending web of supporting material and printable label material having a coating of pressure sensitive adhesive releasably adhered to the supporting material, lines of partial severing in the supporting material web extending transversely across the entire width of the supporting material web at longitudinally spaced apart intervals to provide a plurality of record assemblies, a first line of complete severing in the supporting material web extending longitudinally between side edges of the supporting material web, a plurality of second lines of partial severing in the supporting material web between each pair of adjacent transverse lines of partial severing and extending transversely of the supporting material web at longitudinally spaced apart intervals, the second lines of partial severing extending between an edge of the supporting material web and the first line of complete severing, longitudinally spaced apart feed holes in opposite marginal side edges of the supporting material web adjacent the side edges, the label material of each record assembly being generally rectangular, a first line of partial severing in the label material extending longitudinally along generally the same line as the first line of complete severing in the supporting material web, and a plurality of second lines of at least partial severing in the label material extending transversely of the supporting material web along generally the same lines as the second lines of partial severing in the supporting material web, the second lines of partial severing in the supporting material web and the second lines of at least partial severing in the label material dividing the portions of the record assemblies on one side of the longitudinal first lines into at least three record sections, the supporting material on the other side of the first line of complete severing being readily removable, the record assemblies being separable from the web and the record sections of each separated record assembly being foldable upon each other and positionable under the portion of the label material on the other side of the first lines, the label material on the other side of the first line being free of any transverse line of complete severing extending from the first line to a side edge of the label material.

2. A web of record assemblies, comprising: a composite web having a longitudinally extending web of supporting material and printable label material having a coating of pressure sensitive adhesive releasably adhered to the supporting material, lines of partial severing in the supporting material web extending transversely across the entire width of the supporting material web at longitudinally spaced apart intervals to provide a plurality of record assemblies, a first line of complete severing in the supporting material web extending longitudinally between side edges of the supporting material web, a plurality of second lines of partial severing in the supporting material web between each pair of adjacent transverse lines of partial severing and extending transversely of the supporting material web at longitudinally spaced apart intervals, the second lines of partial severing extending between an edge of the supporting material web and the first line of at least partial severing, longitudinally spaced apart feed holes in opposite marginal side edges of the supporting material web adjacent the side edges, the label material of each record assembly being generally rectangular, a first line of partial severing in the label material extending longitudinally along generally the same line as the first line of complete severing in the supporting material web, and a plurality of second lines of at least partial severing in the label material extending transversely of the supporting material web along generally the same lines as the second lines of partial severing in the supporting material web, the second lines of partial severing in the supporting material web and the second lines of at least partial severing in the label material dividing the portions of the record assemblies on one side of the longitudinal first lines into at least three record sections, wherein the first line of partial severing in the label material includes elongated complete cuts at the outboard ones of the record sections, the supporting material on the other side of the first line of complete severing being readily removable, the record assemblies being separable from the web and the record sections of each separated record assembly being foldable upon each other and positionable under the portion of the label material on the other side of the first lines, the label material on the other side of the first line being free of any transverse line of complete severing extending from the first line to a side edge

3. A web of record assemblies, comprising: a composite web having a longitudinally extending web of supporting material and printable label material having a coating of pressure sensitive adhesive releasably adhered to the supporting material, lines of partial severing in the supporting material web extending transversely across the entire width of the supporting material web at longitudinally spaced apart intervals to provide a plurality of record assemblies, a first line of complete severing in the supporting material web extending longitudinally between side edges of the supporting material web, a plurality of second lines of partial severing in the supporting material web between each pair of adjacent transverse lines of partial severing and extending transversely of the supporting material web at longitudinally spaced apart intervals, the second lines of partial severing extending between an edge of the supporting material web and the first line of complete severing, longitudinally spaced apart feed holes in opposite marginal side edges of the supporting material web adjacent the side edges, the label material of each record assembly being generally rectangular, a first line of partial severing in the label material extending longitudinally along generally the same line as the first line of complete severing in the supporting material web, and a plurality of second lines of at least partial severing in the label material extending transversely of the supporting material web along generally the same lines as the second lines of partial severing in the supporting material web, the second lines of partial severing in the supporting material web and the second lines of at least partial severing in the label material dividing the portions of the record assemblies on one side of the longitudinal first lines into at least three record sections, wherein the first line of partial severing in the label material includes elongated complete cuts at the outboard ones of the record sections, the complete cuts terminating short of the respective ends of the label material, the supporting material on the other side of the first lines of complete severing being readily removable, the record assemblies being separable from the web and the record sections of each separated record assembly being foldable upon each other and positionable under the portion of the label material on the other side of the first lines, the label material on the other side of the first line being free of any transverse line of complete severing extending from the first line to a side edge of the label material.

4. A web of record assemblies, comprising: a composite web having a longitudinally extending web of supporting material and printable label material having a coating of pressure sensitive adhesive releasably adhered to the supporting material, lines of partial severing in the supporting material web extending transversely across the entire width of the supporting material web at longitudinally spaced apart intervals to provide a plurality of record assemblies, a first line of complete severing in the supporting material web extending longitudinally between side edges of the supporting material web, a plurality of second lines of partial severing in the supporting material web between each pair of adjacent transverse lines of partial severing and extending transversely of the supporting material web at longitudinally spaced apart intervals, the second lines of partial severing extending between an edge of the supporting material web and the first line of complete severing, longitudinally spaced apart feed holes in opposite marginal side edges of the supporting material web adjacent the side edges, the label material of each record assembly being generally rectangular, a first line of partial severing in the label material extending longitudinally along generally the same line as the first line of complete severing in the supporting material web, a plurality of second lines of at least partial severing in the label material extending transversely of the supporting material web along generally the same lines as the second lines of partial severing in the supporting material web, the second lines of partial severing in the supporting material web and the second lines of at least partial severing in the label material dividing the portions of the record assemblies on one side of the first lines into at least three record sections, wherein the first line of partial severing in the label material includes elongated complete cuts at the outboard one of the record sections, and at least one third longitudinal line of at least partial severing in the label material on the one side of the first longitudinal line for dividing the label material of the record sections into a plurality of labels, the supporting material on the other side of the first line of complete severing being readily removable, the record assemblies being separable from the web and the record sections of each separated record assembly being foldable upon each other and positionable under the portion of the label material on the other side of the first lines, the label material on the other side of the first line being free of any transverse line of complete severing extending from the first line to a side edge of the label material.

5. A web of record assemblies, comprising: a composite web having a longitudinally extending web of supporting material and printable label material having a coating of pressure sensitive adhesive releasably adhered to the supporting material, lines of partial severing in the supporting material web extending transversely across the entire width of the supporting material web at longitudinally spaced apart intervals to provide a plurality of record assemblies, a first line of complete severing in the supporting material web extending longitudinally between side edges of the supporting material web, a plurality of second lines of partial severing in the supporting material web between each pair of adjacent transverse lines of partial severing and extending transversely of the supporting material web at longitudinally spaced apart intervals, the second lines of partial severing extending between an edge of the supporting material web and the first line of at least partial severing, longitudinally spaced apart feed holes in opposite marginal side edges of the supporting material web adjacent the side edges, the label material of each record assembly being generally rectangular, a first line of partial severing in the label material extending longitudinally along generally the same line as the first line of complete severing in the supporting material web, a plurality of second lines of at least partial severing in the label material extending transversely of the supporting material extending transversely of the supporting material web along generally the same lines as the second lines of partial severing in the supporting material web, the second lines of partial severing in the supporting material and the second lines of at least partial severing in the label material dividing the portions of the record assemblies on one side of the first lines into at least three record sections, wherein the first line of partial severing in the label material includes elongated complete cuts at the outboard ones of the record sections, and at least one third longitudinal line of at least partial severing in the label material on the one side of the first longitudinal line for dividing the label material of the record sections into a plurality of labels, the supporting material on the other side of the first line of complete severing being readily removable, the record assemblies being separable from the web and the record sections of each separated record assembly being foldable upon each other and positionable under the portion of the label material on the other side of the first lines, the label material on the other side of the first line being free of any transverse line of complete severing extending from the first line to a side edge of the label material.

6. A web of record assemblies, comprising: a composite web having a longitudinally extending web of supporting material and printable label material having a coating of pressure sensitive adhesive releasably adhered to the supporting material, lines of partial severing in the supporting material web extending transversely across the entire width of the supporting material web at longitudinally spaced apart intervals to provide a plurality of record assemblies a first line of complete severing in the supporting material web extending longitudinally between side edges of the first supporting material web, a plurality of second lines of partial severing in the supporting material web between each pair of adjacent transverse lines of partial severing and extending transversely of the supporting material web at longitudinally spaced apart intervals, the second lines of partial severing extending between an edge of the supporting material web and the first line of complete severing, longitudinally spaced apart feed holes in opposite marginal side edges of the supporting material web adjacent the side edges, the label material of each record assembly being generally rectangular, a first line of partial severing in the label material extending longitudinally along generally the same line as the first line of complete severing in the supporting material web, a plurality of second lines of at least partial severing in the label material extending transversely of the supporting material web along generally the same lines as the second lines of partial severing in the supporting material web, the second lines of partial severing in the supporting material web and the second lines of at least partial severing in the label material dividing the portions of the record assemblies on one side of the first lines into at least three record sections, wherein the first line of partial severing in the label material includes elongated complete cuts at the outboard ones of the record sections, the complete cuts terminating short of the respective ends of the label material, and at least one third longitudinal line of at least partial severing in the label material on the one side of the first longitudinal line for dividing the label material of the record sections into a plurality of labels, the supporting material on the other side of the first lines of complete severing being readily removable, the record assemblies being separable from the web and the record sections of each separated record assembly being foldable upon each other and positionable under the portion of the label material on the other side of the first lines, the label material on the other side of the first line being free of any transverse line of complete severing extending from the first line to a side edge of the label material.

7. A web of record assemblies, comprising: a composite web having a longitudinally extending web of supporting material and printable label material having a coating of pressure sensitive adhesive releasably adhered to the supporting material, lines of partial severing in the supporting material web extending transversely across the entire width of the supporting material web at longitudinally spaced apart intervals to provide a plurality of record assemblies, a first line of complete severing in the supporting web of each record assembly extending in a first direction, a plurality of second lines of partial severing in the supporting material web extending in a second direction from one end of the supporting material of each record assembly to the line of complete severing, longitudinally spaced apart feed holes in opposite marginal side edges of the supporting material web adjacent the side edges, the label material of each record assembly being generally rectangular, a first line of partial severing in the label material extending in the first direction along generally the same line as the first line of complete severing in the supporting material web, and a plurality of second lines of at least partial severing in the label material extending in the second direction along generally the same lines as the second lines of partial severing in the supporting material web, the second lines of partial severing in the supporting material web and the second lines of at least partial severing in the label material dividing the portions of the record assemblies on one side of the first lines into at least three record sections, the supporting material on the other side of the first line of complete severing being readily removable, the record assemblies being separable from the web and the record sections of each separated record assembly being foldable upon each other and positionable under the portion of the label material on the other side of the first lines, the label material on the other side of the first line being free of any transverse line of complete severing extending from the first line to a side edge of the label material.

8. A web of record assemblies, comprising: a composite web having a longitudinally extending web of supporting material and printable label material having a coating of pressure sensitive adhesive releasably adhered to the supporting material, lines of partial severing in the supporting material web extending transversely across the entire width of the supporting material web at longitudinally spaced apart intervals to provide a plurality of record assemblies, a first line of complete severing in the supporting web of each record assembly extending in a first direction, a plurality of second lines of partial severing in the supporting material web extending in a second direction from one end of the supporting material of each record assembly to the line of complete severing, longitudinally spaced apart feed holes in opposite marginal side edges of the supporting material web adjacent the side edges, the label material of each record assembly being generally rectangular, a first line of partial severing in the label material extending in the first direction along generally the same line as the first line of complete severing in the supporting material web, and a plurality of second lines of at least partial severing in the label material extending in the second direction along generally the same lines as the second lines of partial severing in the supporting material web, the second lines of partial severing in the supporting material web and the second lines of at least partial severing in the label material dividing the portions of the record assemblies on one side of the first lines into at least three record sections, wherein the first line of partial severing in the label material includes elongated complete cuts at the outboard one of the record sections, the supporting material on the other side of the first line of complete severing being readily removable, the record assemblies being separable from the web and the record sections of each separated record assembly being foldable upon each other and positionable under the portion of the label material on the other side of the first lines, the label material on the other side of the first line being free of any transverse line of complete severing extending from the first line to a side edge of the label material.

9. A web of record assemblies, comprising: a composite web having a longitudinally extending web of supporting material and printable label material having a coating of pressure sensitive adhesive releasably adhered to the supporting material, lines of partial severing in the supporting material web extending transversely across the entire width of the supporting material web at longitudinally spaced apart intervals to provide a plurality of record assemblies, a first line of complete severing in the supporting web of each record assembly extending in a first direction, a plurality of second lines of partial severing in the supporting material web extending in a second direction from one end of the supporting material of each record assembly to the line of complete severing, longitudinally spaced apart feed holes in opposite marginal side edges of the supporting material web adjacent the side edges, the label material of each record assembly being generally rectangular, a first line of partial severing in the label material extending in the first direction along generally the same line as the first line of complete severing in the supporting material web, and a plurality of second lines of at least partial severing in the label material extending in the second direction along generally the same lines as the second lines of partial severing in the supporting material web, the second lines of partial severing in the supporting material web and the second lines of at least partial severing in the label material dividing the portions of the record assemblies on one side of the first lines into at least three record sections, wherein the first line of partial severing in the label material includes elongated complete cuts at the outboard ones of the record sections, the complete cuts terminating short of the respective ends of the label material, the supporting material on the other side of the first line of complete severing being readily removable, the record assemblies being separable from the web and the record sections of each separated record assembly being foldable upon each other and positionable under the portion of the label material on the other side of the first lines, the label material on the other side of the first line being free of any transverse line of complete severing extending from the first line to a side edge of the label material.

10. A web of record assemblies, comprising: a composite web having a longitudinally extending web of supporting material and printable label material having a coating of pressure sensitive adhesive releasably adhered to the supporting material, lines of partial severing in the supporting material web extending transversely across the entire width of the supporting material web at longitudinally spaced apart intervals to provide a plurality of record assemblies, a first line of complete severing in the supporting web of each record assembly extending in a first direction, a plurality of second lines of partial severing in the supporting material web extending in a second direction from one end of the supporting material of each record assembly to the line of complete severing, longitudinally spaced apart feed holes in opposite marginal side edges of the supporting material web adjacent the side edges, the label material of each record assembly being generally rectangular, a first line of partial severing in the label material extending in the first direction along generally the same line as the line of complete severing in the supporting material web, a plurality of second lines of at least partial severing in the label material extending in the second direction along generally the same lines as the second lines of partial severing in the supporting material web, the second lines of partial severing in the supporting material web and the second lines of at least partial severing in the label material dividing the portions of the record assemblies on one side of the first lines into at least three record sections, and at least one third line of at least partial severing in the label material extending in the first direction for dividing the label material of the record sections into a plurality of labels, the supporting material on the other side of the first line of complete severing being readily removable, the record assemblies being separable from the web and the record sections of each separated record assembly being foldable upon each other and positionable under the portion of the label material on the other side of the first lines, the label material on the other side of the first line being free of any transverse line of complete severing extending from the first line to a side edge of the label material.

11. A web of record assemblies, comprising: a composite web having a longitudinally extending web of supporting material and printable label material having a coating of pressure sensitive adhesive releasably adhered to the supporting material, lines of partial severing in the supporting material web extending transversely across the entire width of the supporting material web at longitudinally spaced apart intervals to provide a plurality of record assemblies, a first line of complete severing in the supporting web of each record assembly extending in a first direction, a plurality of second lines of partial severing in the supporting material web extending in a second direction from one end of the supporting material of each record assembly to the line of complete severing, longitudinally spaced apart feed holes in opposite marginal side edges of the supporting material web adjacent the side edges, the label material of each record assembly being generally rectangular, a first line of partial severing in the label material extending in the first direction along generally the same line as the line of complete severing in the supporting material web, a plurality of second lines of at least partial severing in the label material extending in the second direction along generally the same lines as the second lines of partial severing in the supporting material web, the second lines of partial severing in the supporting material web and the second lines of at least partial severing in the label material dividing the portions of the record assemblies on one side of the first lines into at least three record sections, wherein the first line of partial severing in the label material includes elongated complete cuts at the outboard ones of the record sections, and at least one third line of at least partial severing in the label material extending in the first direction for dividing the label material of the record sections into a plurality of labels, the supporting material on the other side of the first line of complete severing being readily removable, the record assemblies being separable from the web and the record sections of each separated record assembly being foldable upon each other and positionable under the portion of the label material on the other side of the first lines, the label material on the other side of the first line being free of any line of complete severing extending in the second direction from the first line to a side edge of the label material.

12. A web of record assemblies, comprising: a composite web having a longitudinally extending web of supporting material and printable label material having a coating of pressure sensitive adhesive releasably adhered to the supporting mqaterial, lines of partial severing in the supporting material web extending transversely across the entire width of the supporting material web at longitudinally spaced apart intervals to provide a plurality of record assemblies, a first line of complete severing in the supporting web of each record assembly extending in a first direction, a plurality of second lines of partial severing in the supporting material web extending in a second direction from one end of the supporting material of each record assembly to the line of complete severing, longitudinally spaced apart feed holes in opposite marginal side edges of the supporting material web adjacent the side edges, the label material of each record assembly being generally rectangular, a first line of partial severing in the label material extending in the first direction along generally the same line as the line of complete severing in the supporting material web, a plurality of second lines of at least partial severing in the label material extending in the second direction along generally the same lines as the second lines of partial severing in the supporting material web, and at least one third line of at least partial severing in the label material extending in the first direction for dividing the label material of the second sections into a plurality of labels, the second lines of partial severing in the supporting material web and the second lines of at least partial severing in the label material dividing the portions of the record assemblies on one side of the first lines into at least three record sections, wherein the first line of partial severing in the label material includes elongated complete cuts at the outboard ones of the record sections, the complete cuts terminating short of the respective ends of the label material, the supporting material on the other side of the first line of complete severing being readily removable, the record assemblies being separable from the web and the record sections of each separated record assembly being foldable upon each other and positionable under the portion of the label material on the other side of the first lines, the label material on the other side of the first line being free of any line of complete severing extending in the second direction from the first line to a side edge of the label material.

* * * * *

UNITED STATES PATENT AND TRADEMARK OFFICE

CERTIFICATE OF CORRECTION

PATENT NO. : 3,993,814

DATED : November 23, 1976

INVENTOR(S) : Donald E. Cavender

It is certified that error appears in the above-identified patent and that said Letters Patent are hereby corrected as shown below:

Column 2, line 5, "lines" should be --line--. Column 4, line 4, "89" should be --89¢--; line 62, "label" has been misspelled. Column 5, line 5, "through" has been misspelled. Column 9, line 6, after "assemblies" a comma --,-- has been omitted.

Signed and Sealed this

*Twentieth* Day of *September 1977*

[SEAL]

*Attest:*

RUTH C. MASON
*Attesting Officer*

LUTRELLE F. PARKER
*Acting Commissioner of Patents and Trademarks*